US007888581B2

(12) United States Patent
Fratti et al.

(10) Patent No.: US 7,888,581 B2
(45) Date of Patent: Feb. 15, 2011

(54) METHOD AND APPARATUS FOR ADJUSTING THE CADENCE OF MUSIC ON A PERSONAL AUDIO DEVICE

(75) Inventors: Roger A. Fratti, Mohnton, PA (US); Cathy Lynn Hollien, Bridgewater, NJ (US)

(73) Assignee: Agere Systems Inc., Allentown, PA (US)

( * ) Notice: Subject to any disclaimer, the term of this patent is extended or adjusted under 35 U.S.C. 154(b) by 30 days.

(21) Appl. No.: 12/228,197

(22) Filed: Aug. 11, 2008

(65) Prior Publication Data

US 2010/0031805 A1 Feb. 11, 2010

(51) Int. Cl.
*G10H 1/00* (2006.01)

(52) U.S. Cl. ..... 84/616; 84/636; 84/652; 84/668

(58) Field of Classification Search ..... 84/612, 84/636, 652, 668, 616
See application file for complete search history.

(56) References Cited

U.S. PATENT DOCUMENTS

| | | | | |
|---|---|---|---|---|
| 6,344,607 | B2 * | 2/2002 | Cliff | 84/611 |
| 6,518,492 | B2 * | 2/2003 | Herberger et al. | 84/636 |
| 7,208,672 | B2 * | 4/2007 | Camiel | 84/625 |
| 7,424,117 | B2 * | 9/2008 | Herberger et al. | 381/61 |
| 7,518,053 | B1 * | 4/2009 | Jochelson et al. | 84/609 |
| 7,525,037 | B2 * | 4/2009 | Hansson et al. | 84/615 |
| 2001/0017829 | A1 * | 8/2001 | Inoue et al. | 369/47.23 |
| 2001/0039872 | A1 * | 11/2001 | Cliff | 84/609 |
| 2002/0148347 | A1 * | 10/2002 | Herberger et al. | 84/636 |
| 2004/0159221 | A1 * | 8/2004 | Camiel | 84/660 |
| 2004/0254660 | A1 * | 12/2004 | Seefeldt | 700/94 |
| 2005/0047614 | A1 * | 3/2005 | Herberger et al. | 381/119 |
| 2006/0107822 | A1 * | 5/2006 | Bowen | 84/612 |
| 2007/0266843 | A1 * | 11/2007 | Schneider | 84/612 |
| 2008/0249644 | A1 * | 10/2008 | Jehan | 700/94 |
| 2009/0049979 | A1 * | 2/2009 | Naik et al. | 84/636 |
| 2009/0178542 | A1 * | 7/2009 | Jochelson et al. | 84/609 |

FOREIGN PATENT DOCUMENTS

| | | | |
|---|---|---|---|
| JP | 08234791 | * | 9/1996 |

OTHER PUBLICATIONS

U.S. Appl. No. 12/288,000, filed Oct. 15, 2008, "Method and Apparatus for Adjusting the Cadence of Music on a Personal Audio Device".

* cited by examiner

*Primary Examiner*—David S. Warren
(74) *Attorney, Agent, or Firm*—Ryan, Mason & Lewis, LLP

(57) ABSTRACT

Disclosed is an audio device that adjusts the cadence of played songs. All songs in a playlist may be adjusted to match the cadence of a particular song. First, the desired cadence of a reference song is determined by low pass filtering a digital representation of the reference song and determining the period (T) of the back beat of the reference song. The cadence of subsequent songs is then determined by low pass filtering digital representations of the subsequent songs and determining the period (T) of the back beat of the subsequent songs. An adjustment of the period (T) of the subsequent songs is then determined such that the adjustment of the period (T) of the subsequent songs results in the subsequent songs having the desired cadence (i.e., the cadence of the reference song). The period (T) of the back beat of the subsequent songs are then adjusted.

14 Claims, 3 Drawing Sheets

200

METHOD AND APPARATUS FOR ADJUSTING THE CADENCE OF MUSIC ON A PERSONAL AUDIO DEVICE

BACKGROUND OF THE INVENTION

The present invention relates generally to personal audio devices, and more particularly to adjusting the cadence of music on a personal audio device.

Many people like to listen to music while exercising. In some instances, an improved workout may be achieved if the rhythm of the music is well suited to the cadence of the workout. In order to clearly describe the present invention, several terms are defined as follows. First, cadence is generally used to describe the measure or beat of movement, such as during a march. The regular movement of the marchers defines a cadence. A person exercising may also have a cadence. For example, a jogger will have a cadence defined by his/her feet touching the ground. The regularity of stride of the jogger will define the cadence.

Music may also have a cadence. Each song has certain characteristics. A song's back beat is the regular or periodic pulsation of the music. The back beat of a song is often readily apparent to a listener. Very often, a listener will tap his/her feet or clap his/her hands to the back beat. Music also has a tempo, which is the speed or pace at which the music is played. The period (T) of the back beat is the time duration between the regular pulsations of the back beat. It is noted that the period (T) of the back beat of a song is sometimes referred to herein simply as the period (T) of the song. The period (T) will depend upon the particular song as well as the tempo at which it is being played. As used herein, the term cadence will also be used to describe the rhythmic beat, or pace, of the music. The cadence of a song is generally dependent upon the period T of the back beat.

During an exercise session, an improved workout may be achieved if the cadence of the song matches the cadence of the exercise. For example, if the cadence of the song matches the cadence of a jogger, the jogger may be able to run more consistently. In addition, if the cadence of the song is slightly faster than the normal cadence of the runner, the runner may be motivated to run at a faster than normal pace.

A problem arises when a person listens to multiple songs (e.g., in a playlist) during an exercise session. Since different songs generally have different cadences, the exercise routine may be disrupted by the change in cadence between songs.

BRIEF SUMMARY OF THE INVENTION

The present invention solves the problem described above by adjusting the cadence of songs played on a personal audio device. This invention may be particularly useful during an exercise routine and may be used to adjust all the songs in a playlist to have the cadence of a particular song.

In one embodiment, the cadence of a reference song is determined. The reference song may be, for example, a song which has a desired cadence. For example, a runner may like running to a particular song because its cadence closely matches the runner's desired cadence. This song may be chosen as the reference song and this song's cadence becomes the desired cadence for subsequent songs. In accordance with one aspect of the invention, the cadence of subsequent songs is automatically adjusted by the audio device to match the desired cadence.

In particular embodiments, the cadence of the reference song, as well as the cadence of the subsequent songs, may be determined by low pass filtering digital representations of the songs and determining the period (T) of the back beat of the songs. An adjustment of the period (T) of the subsequent songs is then determined such that the adjustment of the period (T) of the subsequent songs results in the subsequent songs having the desired cadence (i.e., the cadence of the reference song).

In particular embodiments, the period (T) of the back beat of a song may be increased (which results in a slower cadence), by interpolating a digital representation of the song. Alternatively, the period (T) of the back beat of a song may be decreased (which results in a faster cadence), by decimating a digital representation of the song.

These and other advantages of the invention will be apparent to those of ordinary skill in the art by reference to the following detailed description and the accompanying drawings.

DETAILED DESCRIPTION

Figure 1:
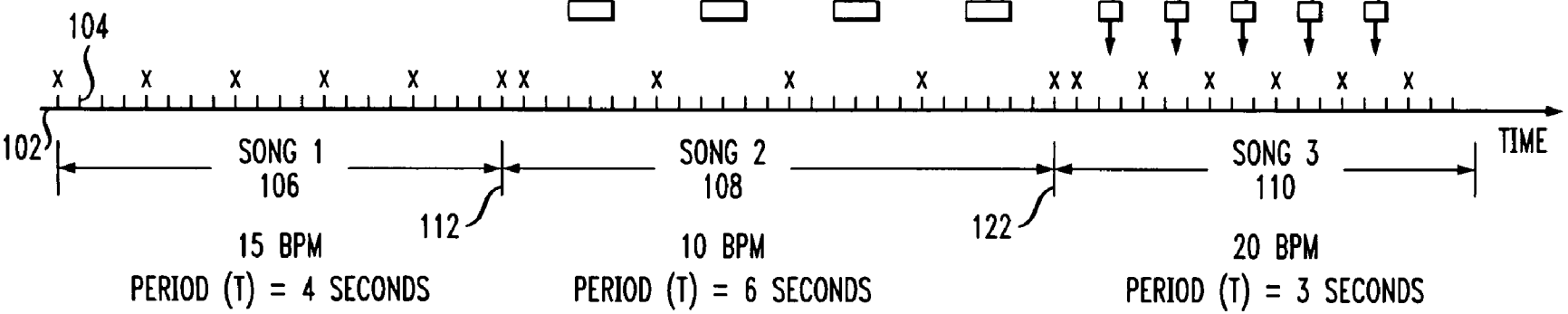
FIG. 1 is a time diagram used to illustrate the principles of the invention.

FIG. 1 is a time diagram which will be used to illustrate the principles of the invention at a high level. FIG. 1 shows a time line 102 with hash marks (e.g., hash mark 104) marked in one second increments. Three songs are also shown, song 1 106, song 2 108 and song 3 110. The "X"'s in the figure illustrate the back beat of each song. For example, the back beat of song 1 106 occurs every 4 seconds as shown, because the "X"'s in the figure occur at every fourth time increment hash mark. Thus, the period (T) of the back beat of song 1 is 4 seconds. At this rate, there will be 15 back beats per minute (BPM). This song 1 has a certain cadence, as defined by the period (T) of the back beat. Assume for purposes of this illustration, that a person exercising finds the cadence of song 1 to be a good match for his/her exercise cadence. However, at time point 112, song 1 106 ends and song 2 108 begins. At this transition point, the cadence of the music changes. As illustrated in FIG. 1, the period (T) of the back beat of song 2 108 is 6 seconds, with 10 BPM. Thus, song 2 has a slower cadence. This could result in an undesirable disruption of the person's exercise routine.

In order to solve this problem, and in accordance with an aspect of the invention, the cadence of song 2 is automatically adjusted in order to match the cadence of song 1. In order to accomplish this adjustment, the cadence of song 2 must be increased from 10 BPM with a period (T) of 6 seconds, to 15 BPM with a period (T) of 4 seconds. In one embodiment of the invention, the digital representation of song 2 is decimated, by removing some samples from the digital representation. This is illustrated in FIG. 1 by removing samples 114, 116, 118 and 120 from the digital representation of song 2. If each sample represents a two second time duration, the song will be effectively compressed, so that song 2 will have a period (T) of 4 seconds and 15 BPM.

Similarly, at time point 122, song 2 108 ends and song 3 110 begins. At this transition point, the cadence of the music changes. As illustrated in FIG. 1, the period (T) of the back beat of song 3 110 is 3 seconds, with 20 BPM. Thus, song 3 has a slower cadence than the desired reference cadence of song 1. Again, this could result in an undesirable disruption of the person's exercise routine.

In order to solve this problem, and in accordance with an aspect of the invention, the cadence of song 3 is automatically adjusted in order to match the cadence of song 1. In order to accomplish this adjustment, the cadence of song 3 must be decreased from 20 BPM with a period (T) of 3 seconds, to 15 BPM with a period (T) of 4 seconds. In one embodiment of the invention, the digital representation of song 3 is interpolated, by inserting additional samples into the digital representation. This is illustrated in FIG. 1 by inserting samples 124, 126, 128, 130 and 132 into the digital representation of song 2. If each sample represents a one second time duration, the song will be effectively stretched, so that song 3 will have a period (T) of 4 seconds and 15 BPM.

One skilled in the art will recognize that FIG. 1 is an unrealistic real world example, because the songs have large discrepancies between their cadences. Further, inserting such large portions into the digital representation (e.g., by interpolating), or removing such large portions from the digital representation (e.g., decimating), would cause too much distortion/disruption to the song. FIG. 1 is used solely as a device to explain the high level principles of the invention, while using a straightforward example. A more realistic example of cadence adjustment is as follows.

Assume song 1 has 60 BPM and a period (T) of the back beat of 1 second. Assume song 2 has 64 BPM with a period (T) of the back beat of 0.9375 seconds. In order to adjust the cadence of song 2 to match song 1, the period (T) of the back beat of song 2 must be adjusted (increased) by an adjustment amount of 0.0625 seconds, or 62.5 ms. Assuming that the audio device samples at the rate of 20 KHz, 1,250 samples need to be inserted for every 20,000 clock cycles in order to increase the period (T) of song 2 to match song 1. Thus, an additional sample will be added every $16^{th}$ clock cycle. This process of adding additional samples to the digital representation of the song is called interpolation.

There are various techniques that may be used for the interpolation. In one embodiment, a copy of the prior sample is added as the inserted sample. This may be advantageous where the cadence of the song only requires minimal lengthening. Alternatively, a more complex form of interpolation may be used. For example, the inserted sample may be calculated using one or more prior samples, and/or one or more subsequent samples. Of course, one skilled in the art will recognize that such calculations would require the use of a buffer and appropriate delay circuits in order to perform interpolation based on prior and/or subsequent samples. One skilled in the art would recognize that there are various other interpolation techniques that may be used as well.

As another more realistic example, assume the inverse of the above example. That is, assume song 1 has 64 BPM and a period (T) of the back beat of 0.9375 seconds. Assume song 2 has 60 BPM with a period (T) of the back beat of 1 second. In order to adjust the cadence of song 2 to match song 1, the period (T) of the back beat of song 2 must be adjusted (decreased) by an adjustment amount of 0.0625 seconds, or 62.5 ms. Assuming that the audio device samples at the rate of 20 KHz, 1,250 samples need to be removed for every 20,000 clock cycles in order to decrease the period (T) of song 2 to match song 1. Thus, a sample will be removed every $16^{th}$ clock cycle. This process of removing samples from the digital representation of the song is called decimation.

Figure 2:
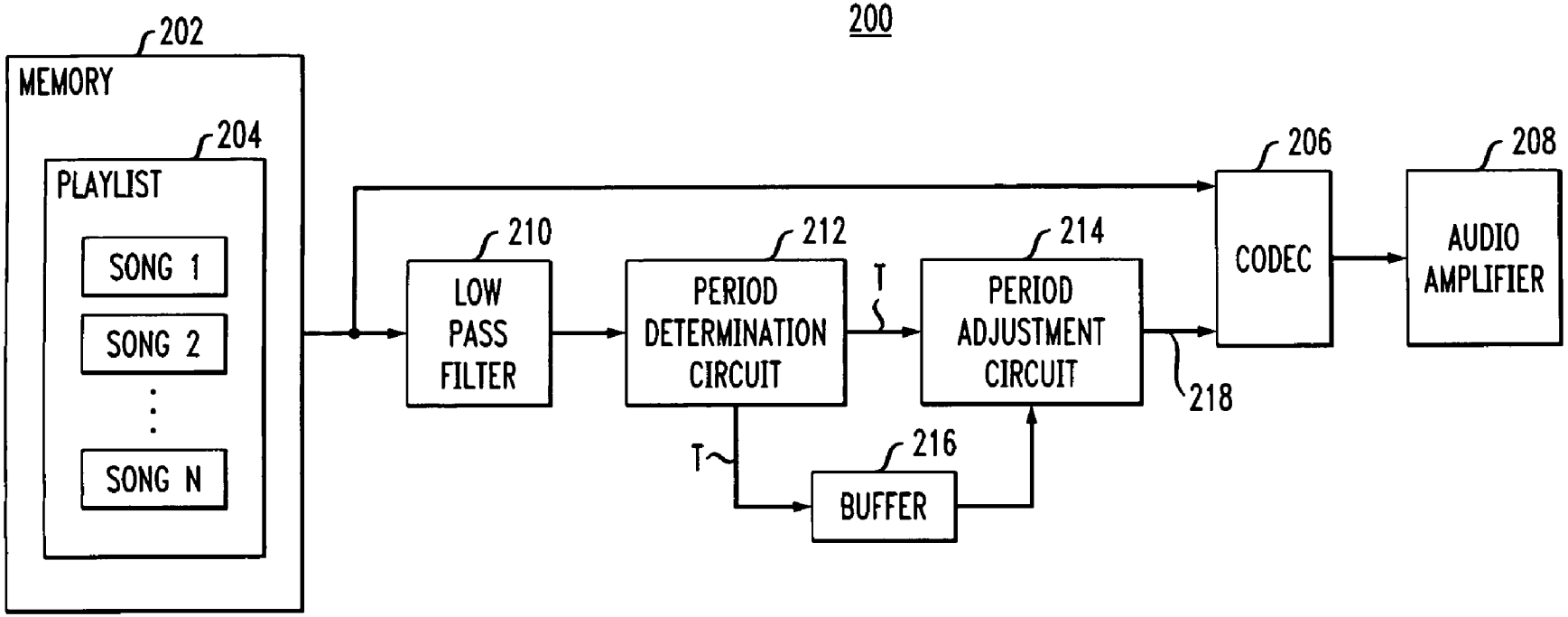
FIG. 2 is a high level block diagram of an audio device configured in accordance with an embodiment of the invention.

FIG. 2 is a high level block diagram of an audio device 200 configured in accordance with one embodiment of the invention. FIG. 2 shows only those components necessary for an understanding of the present invention. One skilled in the art will recognize that certain well known components are not shown. For example, an actual audio device 200 would also include a processor and computer program instructions for controlling various components of the audio device 200. Such computer program instructions would be stored in memory 202, or another computer readable medium, such that the processor could retrieve the instructions and execute the instructions in order to implement the functions of the audio device (e.g., the functions of the flowcharts of FIGS. 3 and 4 as described below). A typical audio device 200 would also include a power source and power circuitry to provide power to the device and its various components. A typical audio device 200 would also include various user interface components (display, buttons, etc.) to allow for user interaction with the device. These additional components are not shown for the sake of clarity. One skilled in the art could readily implement the present invention in an audio device using the description herein.

The audio device 200 includes a memory 202 for storing digital representations of the songs to be played by the device. These songs are typically organized into a playlist 204 comprising a plurality of songs as shown. In a conventional audio device, the digital representation of the songs is provided to a CODEC 206 which decodes the digital representation of the song and provides an appropriate analog output signal to an audio amplifier 208. The audio amplifier provides sound to a user through a speaker, headphone, earpiece or the like.

In one embodiment, the present invention adds a low pass filter 210, a period determination circuit 212, a buffer 216, and a period adjustment circuit 214. Further, the function of the CODEC 206 is modified so that it can perform interpolation and decimation (as described above) in response to a control signal 218 received from the period adjustment circuit 214. While low pass filter 210, period determination circuit 212, buffer 216, and period adjustment circuit 214 are shown here as hardware blocks and are described as circuits, it should be recognized that, in various embodiments, the functions of these blocks may be performed by hardware, software, or any combination of hardware and software.

Figure 3:
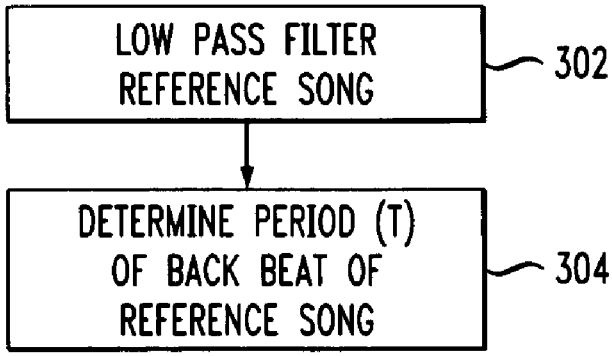
FIG. 3 is a flowchart showing the steps performed in order to determine the desired cadence of a reference song.

The functions of the audio device 200 will be described in conjunction with the flowcharts shown in FIGS. 3 and 4. FIG. 3 shows the steps performed in order to determine the desired cadence of some reference song. The reference song may be determined in various ways. In one embodiment, the first song in a playlist could be considered the reference song. In other embodiments, the reference song could be identified in real time by the user. For example, if the user likes the cadence of a song currently being played, the user could provide some user input to the audio device indicating that the currently playing song should be used as the reference song.

Once the reference song is determined, the steps of FIG. 3 are performed in order to determine the cadence of the reference song. In step 302 the reference song is low pass filtered using low pass filter 210. This low pass filtering is performed in the digital domain using the digital representation of the reference song. The low pass filter removes the high frequency content of the song, with the residual low frequency content being output from the low pass filter 210.

The output of the low pass filter 210 is provided to the period determination circuit 212. In step 304, the period determination circuit 212 uses the output of the low pass filter 210 in order to determine the period (T) of the back beat of the reference song. This period (T) is indicative of the cadence of the reference song, and is used as the desired cadence for processing subsequent songs. One method for determining the period (T) is by counting clock cycles between adjacent peaks of the signal received from the low pass filter. The period (T) of the reference song may be stored in a buffer memory 216 for further processing as described below. Since the reference song is not adjusted, the period adjustment circuit 214 does not need to make any adjustment to the period (T) of the reference song. Instead, the CODEC 206 receives the digital representation of the reference song from memory 202 and decodes the song to be output to the audio amplifier 208. The period adjustment circuit 212 (which will be described in further detail below), outputs a control signal 218 to the CODEC 206 indicating that no adjustment is to be made to the reference song currently being played. At the end of the processing of the reference song as shown in FIG. 3, the period (T) of the back beat of the reference song is stored in buffer memory 216 of the audio device 200. As described above, this period (T) is indicative of the cadence of the reference song, and is used to adjust subsequent songs as described below in connection with FIG. 4.

In one embodiment, the steps of FIG. 3 are performed once per reference song. That is, the period (T) of the back beat of the reference song is determined once, and that period (T) is used as the reference period. However, since the period (T) of the back beat of the reference song may change during the song, various alternatives for determining the period (T) of the reference song are possible. For example, the period (T) could be determined at various points in the song, and the period (T) that is most prevalent throughout the song may be used. Alternatively, the period (T) at the instant the user provides some user input may be used as the reference period. Alternatively, some average period (T) determined at several points throughout the song may be used.

Figure 4:
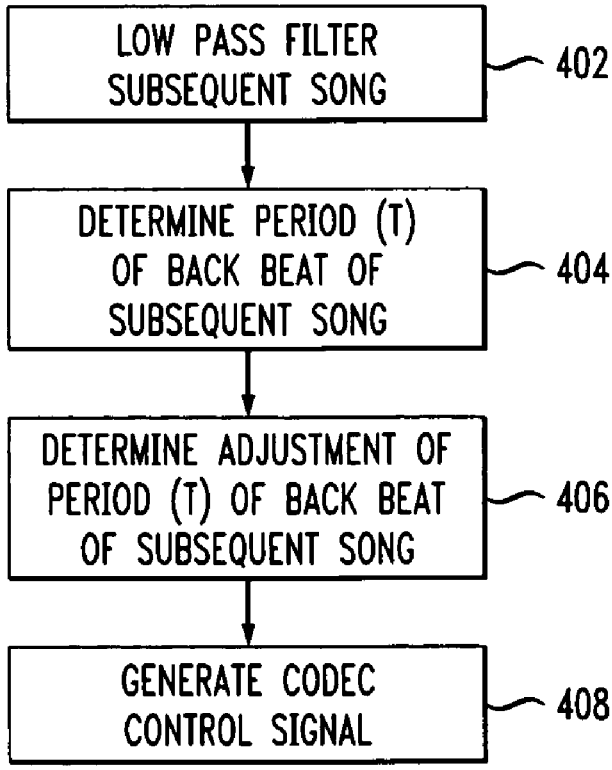
FIG. 4 is a flowchart showing the steps performed in order to adjust a subsequent song so that its cadence matches the desired cadence of a reference song.

FIG. 4 is a flowchart showing the steps performed in order to adjust a subsequent song so that its cadence matches the desired cadence of the reference song. For example, the subsequent song may be song 2 of the playlist 204, where song 1 is the reference song having the desired cadence. First, in step 402, the song is low pass filtered using low pass filter 210. This low pass filtering is performed in the digital domain using the digital representation of the subsequent song. This low pass filtering of step 402 is as described above in connection with step 302 of FIG. 3.

The output of the low pass filter 210 is provided to the period determination circuit 212. In step 404, the period determination circuit 212 uses the output of the low pass filter 210 in order to determine the period (T) of the back beat of the subsequent song. This period determination of step 404 is as described above in connection with step 304 of FIG. 3. This period (T) is indicative of the cadence of the subsequent song.

The period (T) of the subsequent song is received by the period adjustment circuit 214 from the period determination circuit 212. The period (T) of the reference song is received by the period adjustment circuit 214 from the buffer memory 216. Next, in step 406, the period adjustment circuit 214 determines an adjustment of the period (T) of the back beat of the subsequent song. This adjustment is the adjustment necessary to the period (T) of the back beat of the subsequent song so that it matches the period (T) of the back beat of the reference song. This adjustment is determined as described above in connection with FIG. 1.

In one embodiment, the adjustment may be calculated as follows.

$$CS = \text{FLOOR}\left[\frac{\left(\frac{1}{BPM_1} - \frac{1}{BPM_2}\right)}{\frac{1}{CLK}}\right]$$

In the above equation, CS represents the cycle slips, which is the number of clock periods to be interpolated or decimated per second. If CS is positive, interpolation will be performed. If CS is negative, decimation will be performed. CLK is the clock rate of the CODEC in Hz. $BPM_1$ and $BPM_2$ represent the beats per minute of the two songs being compared. Floor (x) represents the mathematical function that returns the greatest integer less than or equal to x.

As an example, assume the following values:

$BPM_1$=60 $BPM_2$=65 CLK=20 KHz $T_1$=1/$BPM_1$=16.666 mS $T_2$=1/$BPM_2$=15.38 mS; 1/CLK=0.05 mS

Using the above equation, Cycle Slips (CS)=0.00128 mS/0.05 mS=Floor [25.6]=25. Since the result is a positive number, interpolation will be performed. Spaced across 1 second, 25 clock cycles will be inserted to slow 65 BPM down to 60 BPM.

After the necessary adjustment is calculated in step 406, in step 408 the period adjustment circuit 214 generates a CODEC control signal 218 which is provided to the CODEC 206. The CODEC 206 adjusts the period (T) of the subsequent song as specified by the control signal 218. More particularly, the CODEC 206 receives the digital representation of the song from memory 202 and either interpolates or decimates the digital representation based on the control signal 218. The interpolation or decimation is performed as described above. The output of the CODEC 206 is then provided to the audio amplifier 208 for generation of the analog audio signal to be output to the user of the audio device 200.

The CODEC 206 continues to adjust the period (T) of the subsequent song based on the control signal 218 received from the period adjustment circuit 214. In an advantageous embodiment, the audio device 200 may perform mid-song corrections to the cadence of the subsequent songs. This is advantageous since the period (T) of the back beat of a song may be different at different points throughout the song. Thus, the steps of FIG. 4 may be performed periodically during the playing of each of the subsequent songs to allow for corrections to the control signal 218 at different points in the song. In one embodiment, the steps of FIG. 4 are performed continuously during the playing of each of the subsequent songs, and the control signal 218 is continuously updated to perform corrections to the period (T) of the back beat of the subsequent songs.

In certain embodiments, the cadence adjustment of songs may be encoded into the digital representation of the songs. For example, an indication of whether a song should be considered a reference song, or whether a subsequent song should receive cadence adjustment, could be encoded into the digital representation (e.g., header) of the song itself. In such a case, the circuitry of the audio device would be modified to recognize these headers, and to perform the steps of FIG. 3 and/or FIG. 4 based on this encoding.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An apparatus for adjusting cadences of played songs, the apparatus comprising:

a period determination circuit for determining a period of a back beat of at least one song;

a period adjustment circuit for receiving said period of the back beat of said at least one song and determining a period adjustment signal based on the period of the back beat of said at least one song and a period of a back beat of a reference song; and a CODEC for receiving said period adjustment signal and said digital representation of said at least one song and adjusting a cadence of said at least one song based on said period adjustment signal;

wherein the cadence is adjusted by an amount determined as a function of the period of the back beat of said at least one song, the period of the back beat of said reference song, and a clock rate of the CODEC.

2. The apparatus of claim 1 wherein said period adjustment signal specifies interpolation of a digital representation of said at least one song in order to increase said period of the back beat of said at least one song.

3. The apparatus of claim 1 wherein said period adjustment signal specifies decimation of a digital representation of said at least one song in order to decrease said period of the back beat of said at least one song.

4. The apparatus of claim 1 wherein said amount is calculated at least in part by dividing a difference between the period of the back beat of said at least one song and the period of the back beat of said reference song by a reciprocal of said clock rate.

5. The apparatus of claim 1 further comprising a memory for storing digital representations of songs.

6. The apparatus of claim 1 further comprising a low pass filter for receiving a digital representation of at least one song and generating a signal received by said period determination circuit.

7. The apparatus of claim 1 wherein said reference song is a song currently being played.

8. A personal audio device comprising the apparatus of claim 1.

9. A method for adjusting cadences of played songs, the method comprising the steps of:

determining a period adjustment signal based on a period of a back beat of at least one song and a period of a back beat of a reference song; and adjusting a cadence of said at least one song based on said period adjustment signal;

wherein the cadence is adjusted by an amount determined as a function of the period of the back beat of said at least one song, the period of the back beat of the reference song, and a clock rate of a CODEC.

10. The method of claim 9 wherein said reference song is a song currently being played.

11. The method of claim 9, wherein the adjusting step is performed by the CODEC.

12. The method of claim 9, wherein said period adjustment signal specifies interpolation of a digital representation of said at least one song in order to increase said period of the back beat of said at least one song.

13. The method of claim 9, wherein said period adjustment signal specifies decimation of a digital representation of said at least one song in order to decrease said period of the back beat of said at least one song.

14. The method of claim 9, wherein said amount is calculated at least in part by dividing a difference between the period of the back beat of said at least one song and the period of the back beat of said reference song by a reciprocal of said clock rate.

* * * * *